US011826808B2

(12) United States Patent
Yamauchi et al.

(10) Patent No.: US 11,826,808 B2
(45) Date of Patent: Nov. 28, 2023

(54) COMPRESSIVE TORSION FORMING DEVICE

(71) Applicants: SUMITOMO HEAVY INDUSTRIES, LTD., Tokyo (JP); JAPAN AEROFORGE, LTD., Okayama (JP)

(72) Inventors: Kei Yamauchi, Ehime (JP); Shinya Ishigai, Okayama (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 387 days.

(21) Appl. No.: 17/077,787

(22) Filed: Oct. 22, 2020

(65) Prior Publication Data

US 2021/0039151 A1 Feb. 11, 2021

Related U.S. Application Data

(63) Continuation of application No. PCT/JP2019/015486, filed on Apr. 9, 2019.

(30) Foreign Application Priority Data

Apr. 23, 2018 (JP) ..... 2018-082431

(51) Int. Cl.
*B21D 11/14* (2006.01)
*B21J 1/02* (2006.01)

(52) U.S. Cl.
CPC ..... *B21D 11/14* (2013.01); *B21J 1/02* (2013.01)

(58) Field of Classification Search
CPC ... B21D 11/14; B21J 1/02; B30B 9/32; B30B 9/328
See application file for complete search history.

(56) References Cited

U.S. PATENT DOCUMENTS 5,660,223 A * 8/1997 Thieman ..... B22D 19/0054 164/312

FOREIGN PATENT DOCUMENTS

| | | | |
|---|---|---|---|
| CN | 104399808 | A | 3/2015 |
| JP | S43-024271 | B1 | 10/1968 |
| JP | S53-013978 | Y | 4/1978 |
| JP | S63-082894 | U | 5/1988 |

(Continued)

OTHER PUBLICATIONS

Extended Search Report issued in European Application No. 19793792.3, dated Dec. 22, 2021.

(Continued)

*Primary Examiner* — Teresa M Ekiert
(74) *Attorney, Agent, or Firm* — Michael Best & Friedrich LLP

(57) ABSTRACT

A compressive torsion forming device for processing a processing material using a first die and a second die facing each other includes a sliding portion that includes a first hydraulic chamber, and slides in accordance with a change in internal pressure of the first hydraulic chamber so as to move the first die in a direction of an axis; a rotating table provided with the second die and rotatable about the axis; a table support portion provided opposite to the second die with the rotating table interposed therebetween in the direction of the axis; and a rotational bearing that rotatably supports the rotating table with respect to the table support portion, and receives a force acting on the rotating table in a direction from the second die toward the rotating table.

17 Claims, 4 Drawing Sheets

(56) References Cited

FOREIGN PATENT DOCUMENTS

| | | | |
|---|---|---|---|
| JP | 2002-336996 | A | 11/2002 |
| JP | 2002-336996 | A | 11/2002 |
| JP | 3544312 | B2 | 7/2004 |
| JP | 2006-247734 | A | 9/2006 |
| JP | 2015-223621 | A | 12/2015 |
| JP | 6069145 | B2 | 1/2017 |
| SU | 1013069 | A1 | 4/1983 |

OTHER PUBLICATIONS

International Search Report issued in Application No. PCT/JP2019/015486, dated May 21, 2019.

* cited by examiner

COMPRESSIVE TORSION FORMING DEVICE

RELATED APPLICATIONS

The contents of Japanese Patent Application No. 2018-082431, and of International Patent Application No. PCT/JP2019/015486, on the basis of each of which priority benefits are claimed in an accompanying application data sheet, are in their entirety incorporated herein by reference.

BACKGROUND

Technical Field

Certain embodiments of the present invention relate to a compressive torsion forming device.

Description of Related Art

The high pressure torsion method is known as a method of dividing a processing material such as metal into fine particles to improve the material properties. The high pressure torsion method is a method of applying shear deformation while applying a compressive stress to a processing material. Devices for performing such processing generally have a pair of dies that sandwiches a processing material and are configured such that pressure is applied from one die and the other die is rotatable. In the related art, the die on the rotating side is rotatably attached to a frame via a rotational bearing.

SUMMARY

According to an embodiment of the present invention, there is provided a compressive torsion forming device for processing a processing material using a first die and a second die facing each other, the compressive torsion forming device including a sliding portion that includes a first hydraulic chamber, and slides in accordance with a change in internal pressure of the first hydraulic chamber so as to move the first die in a direction of an axis; a rotating table provided with the second die and rotatable about the axis; a table support portion provided opposite to the second die with the rotating table interposed therebetween in the direction of the axis; a rotational bearing that rotatably supports the rotating table with respect to the table support portion, and receives a force acting on the rotating table in a direction from the second die toward the rotating table; and a second hydraulic chamber that is provided between the rotating table and the table support portion and communicates with the first hydraulic chamber.

DETAILED DESCRIPTION

In the device having the above structure, the rotational bearing receives the applied pressure from the die on the pressure application side. However, since the rotational bearing cannot structurally withstand a large applied pressure, it is difficult to raise the applied pressure.

It is desirable to provide a compressive torsion forming device capable of increasing applied pressure to a processing material.

According to the above compressive torsion forming device, the second hydraulic chamber communicating with the first hydraulic chamber is configured to bear a part of a thrust load generated due to the sliding of the sliding portion and applied to the rotational bearing in the related art and the rotational bearing is configured to bear the remaining load. As a result, the thrust load carried by the rotational bearing can be reduced. Therefore, even when the applied pressure to the processing material is increased, the thrust load received by the rotational bearing can be smaller than the applied pressure. Therefore, it is possible to perform processing with a larger applied pressure compared with the related-art compressive torsion forming device.

Here, an aspect may be adopted in which the rotational bearing may be provided inside the second hydraulic chamber.

By adopting the above configuration, the space for disposing the rotational bearing can be reduced, and the lubricity of the rotational bearing can be improved by the pressure oil in the second hydraulic chamber.

Additionally, an aspect may be adopted in which a rotating mechanism that controls the rotation of the rotating table is further provided.

As described above, by providing the rotating mechanism that controls the rotation of the rotating table, it is possible to perform the pressing compressive deformation and the torsional deformation while increasing the applied pressure applied to the processing material.

Additionally, an aspect may be adopted in which the rotating mechanism includes a turning bearing with external teeth having an outer ring attached to the rotating table.

As described above, since the turning bearing with external teeth is attached to the rotating table, the turning bearing with external teeth can receive the load in the anti-thrust load direction, and the load can be prevented from being generated in the anti-thrust load direction.

Hereinafter, embodiments for carrying out the present invention will be described in detail with reference to the accompanying drawings. In addition, in the description of the drawings, the same elements will be denoted by the same reference signs, and redundant description thereof will be omitted.

Figure 1:
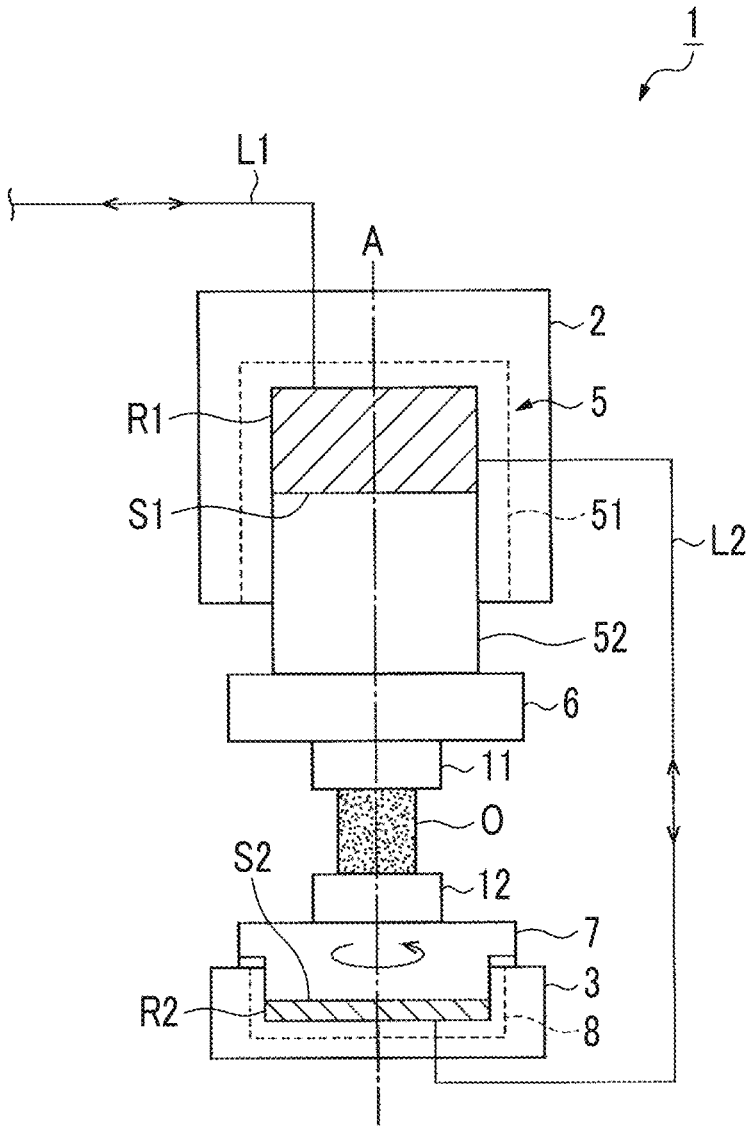
FIG. 1 is a schematic view of a portion related to a hydraulic system in a schematic configuration of a compressive torsion forming device according to the embodiment.
Figure 2:
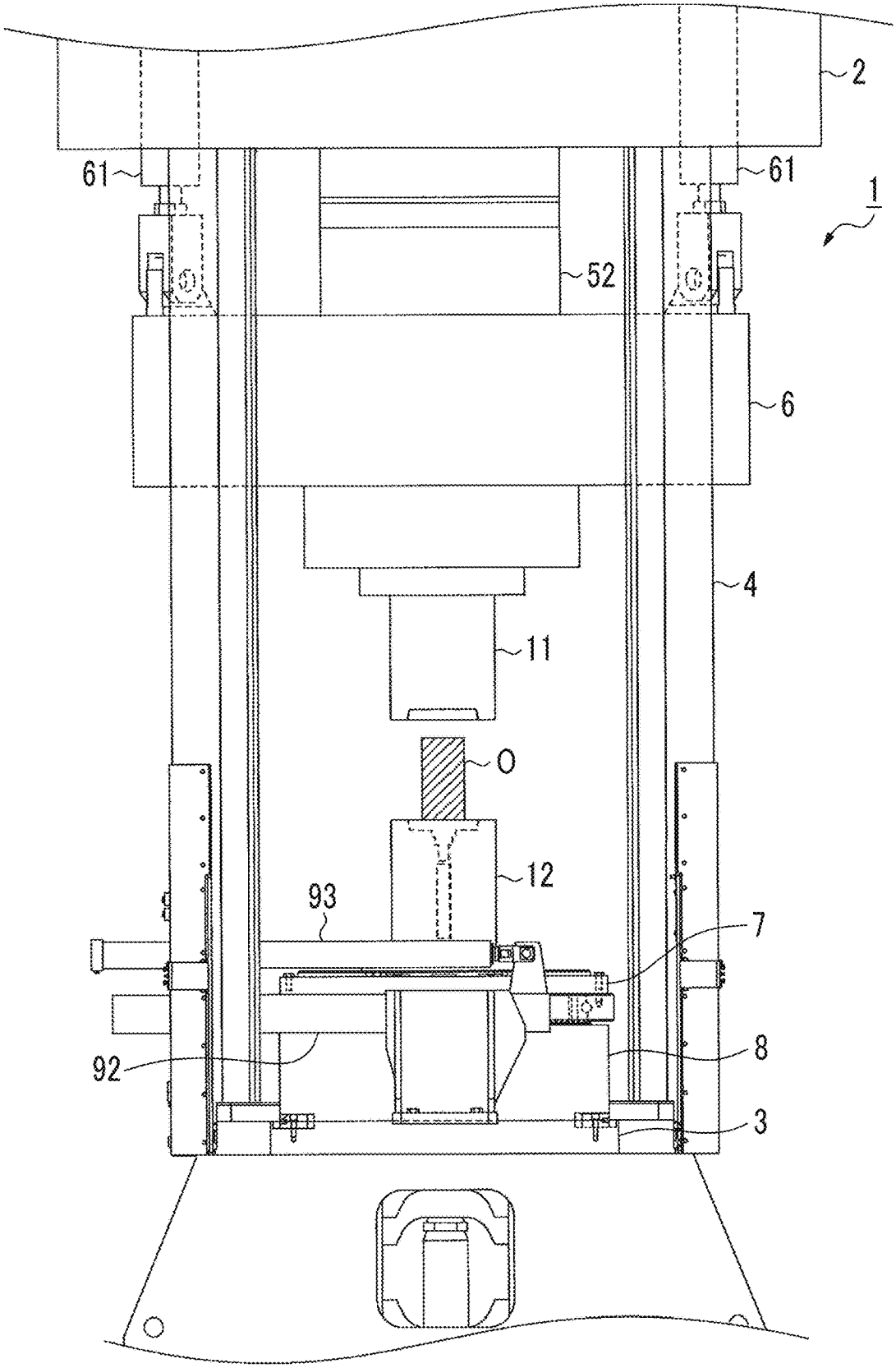
FIG. 2 is a front view of main portions of the compressive torsion forming device.
Figure 3:
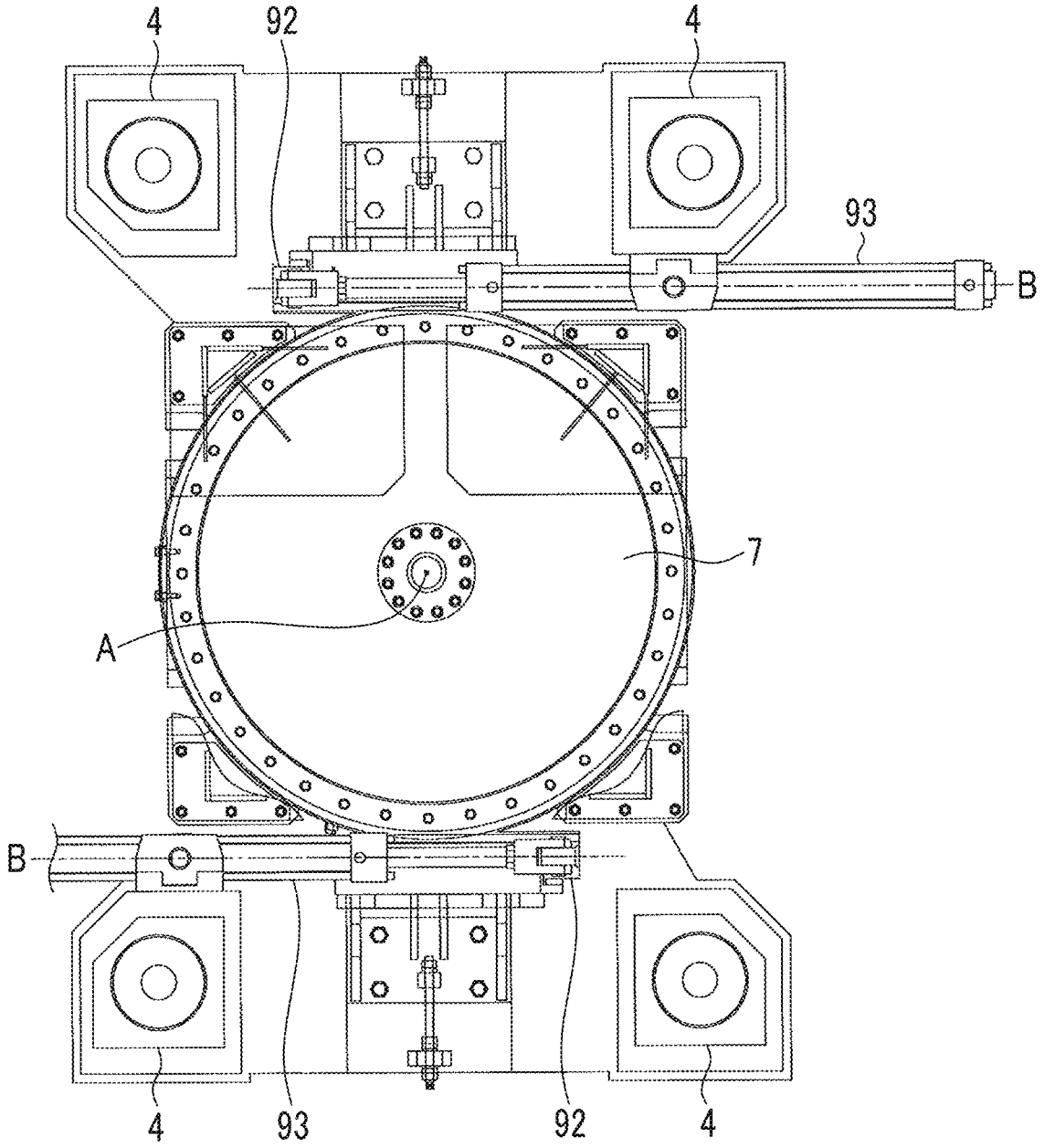
FIG. 3 is a plan view illustrating a configuration in the vicinity of a rotating table and a press cylinder.
Figure 4:
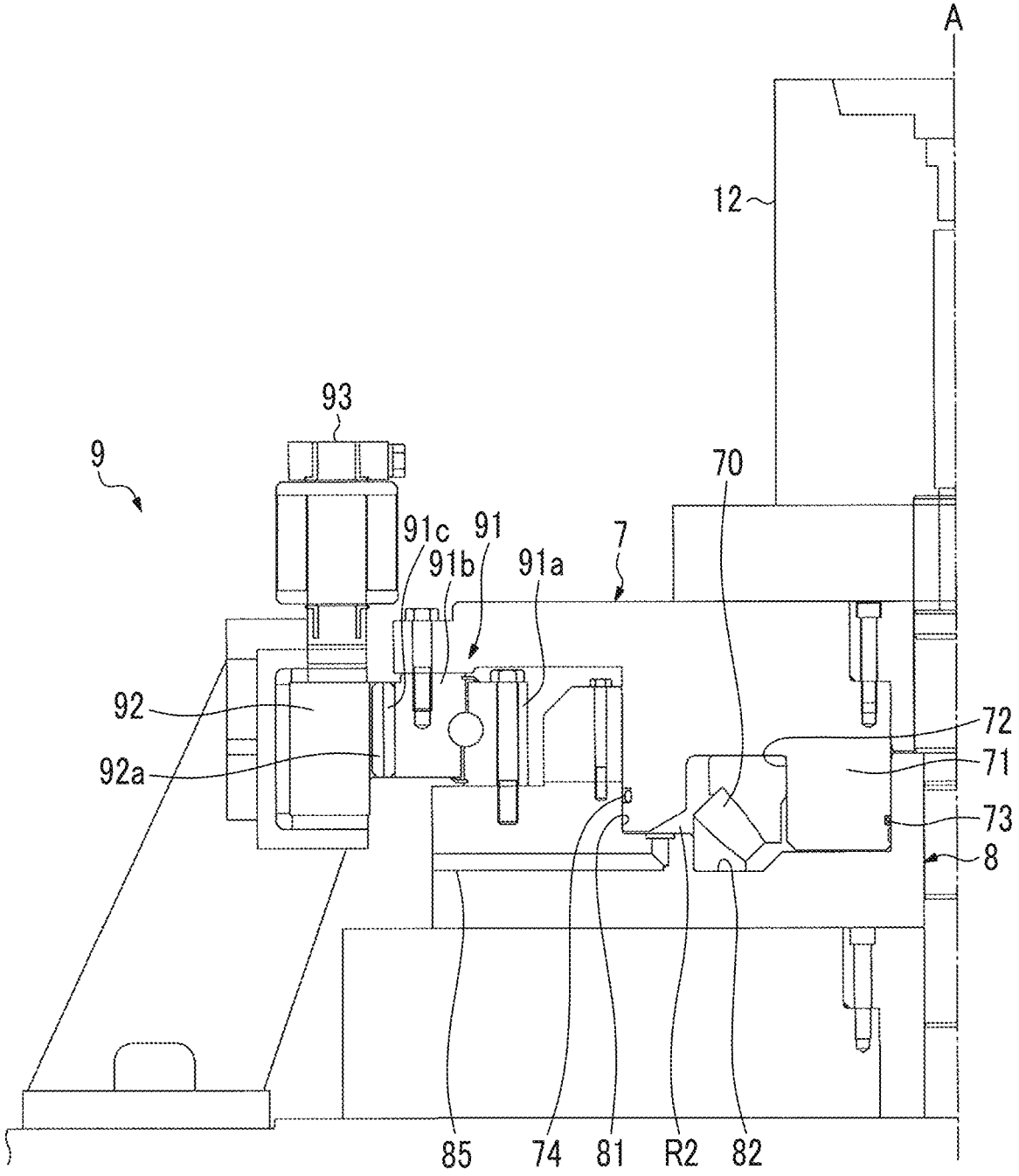
FIG. 4 is a partially sectional view illustrating an operating mechanism of a rotating table.

FIG. 1 is a schematic view of a portion related to a hydraulic system in a schematic configuration of a compressive torsion forming device according to an embodiment of the present invention. Additionally, FIGS. 2 to 4 illustrate a mechanical structure of the compressive torsion forming device, FIG. 2 is a front view of main portions of the compressive torsion forming device, and FIG. 3 is a plan view for explaining the configuration in the vicinity of a rotating table and a press cylinder, and FIG. 4 is a partially sectional view for explaining an operating mechanism of the rotating table.

The compressive torsion forming device 1 according to the present embodiment is configured such that a processing material O is pressed and rotated by an upper die 11 and a lower die 12 in a state where the processing material O is sandwiched between the upper die 11 (first die) and the lower die 12 (second die) that is a pair of dies. The upper die 11 applies a compressive stress to the processing material O by pressing the processing material O. On the other hand, the lower die 12 applies a shear stress to the processing material O by rotating.

The compressive torsion forming device 1 has an upper frame 2, a lower frame 3, and four props 4 (refer to FIGS. 2 and 3) that extend in the vertical direction and couple and support the upper frame 2 and the lower frame 3, and includes a mechanism for applying compression and torsion to the processing material therein.

The upper frame 2 is provided with a ram type press cylinder 5. The press cylinder 5 includes a tube 51 and a ram 52 (sliding portion) that is slidable in the tube 51. The inside of the tube 51 is a first hydraulic chamber R1. A pressure application oil passage L1 that supplies pressure oil (hydraulic oil) for controlling the applied pressure in the press cylinder 5 is connected to the first hydraulic chamber R1. The pressure application oil passage L1 is connected to a hydraulic oil supply source (not illustrated) capable of supplying pressure oil. The internal pressure of the first hydraulic chamber R1 changes with the supply of the pressure oil from the hydraulic oil supply source, and the ram 52 moves in accordance with the change in the internal pressure of the first hydraulic chamber R1.

The upper die 11 is fixed to the ram 52 via a slide 6. The slide 6 is provided with a pullback cylinder 61 coupled to the upper frame 2. The pullback cylinder 61 is used when the press cylinder 5 is retracted. In addition, the upper die 11 may be directly fixed to the ram 52.

A table support portion 8 is attached to the lower frame 3, and a rotating table 7 is provided on the table support portion 8 so as to be rotatable about an axis A. The lower die 12 is fixed on the rotating table 7. Additionally, a rotating mechanism 9 (refer to FIGS. 2 to 4) for rotating the rotating table 7 around the axis A is provided around the rotating table 7. The axis A is an axis oriented in a direction in which the ram 52 moves, and is an axis that coincides with the center of the ram 52.

As illustrated in FIGS. 3 and 4, the rotating table 7 has a disk shape centered on the axis A, and a central portion of a lower surface (a surface opposite to the side on which the lower die 12 is fixed) thereof is provided with an annular protruding portion 71 centered on the axis A. The table support portion 8 has an annular housing portion 81 corresponding to the shape of the protruding portion 71 of the rotating table 7 and is attached in a state where the protruding portion 71 of the rotating table 7 enters the housing portion 81 of the table support portion 8. Additionally, on the lower surface of the rotating table 7, the table support portion 8 and the rotating table 7 are spaced apart from each other on the outer peripheral side of the protruding portion 71, and a turning bearing 91 with external teeth constituting a part of the rotating mechanism 9 is attached in an annular region that is a gap between the table support portion and the rotating table.

The rotating mechanism 9 is configured to include the turning bearing 91 with external teeth, a rack shaft 92, and a hydraulic cylinder 93 that moves the rack shaft 92. The turning bearing 91 with external teeth has an inner ring 91*a*, an outer ring 91*b*, and external teeth 91*c*. The inner ring 91*a* is fixed to the table support portion 8, and the outer ring 91*b* is fixed to the rotating table 7. The external teeth 91*c* are provided on an outer peripheral side of the outer ring 91*b*. The external teeth 91*c* function as a gear when the rotating table 7 rotates.

A rack shaft 92 having rack teeth 92*a* fitted to the external teeth 91*c* is provided outside the external teeth 91*c* of the turning bearing 91 with external teeth. In FIG. 4, only one rack shaft 92 is illustrated, but as illustrated in FIG. 3, two rack shafts 92 are provided so as to be point-symmetrical about the axis A. The two rack shafts 92 extend in the direction of an axis B direction orthogonal to the axis A. Additionally, the two rack shafts 92 are respectively coupled to a hydraulic cylinder 93 extending in the axis B direction and reciprocate in the axis B directions as the hydraulic cylinder 93 fixed to the props 4 extend and retract.

Returning to FIG. 4, the annular protruding portion 71 of the rotating table 7 is provided with an annular recess 72 centered on the axis A. The recess 72 has a shape that is recessed upward from a lower surface of the protruding portion 71. Additionally, the table support portion 8 is also provided with an annular recess 82 that faces the recess 72 and is centered on the axis A. The recess 82 has a shape that is recessed downward from an upper surface of the table support portion 8. A thrust bearing 70 (rotational bearing) is installed in a space formed by the recess 72 and the recess 82. The thrust bearing 70 has a function of receiving a force (thrust load) directed from the lower die 12 to the rotating table 7, which is received by the lower die 12 due to the application of pressure by the upper die 11 and acts on the rotating table 7.

Additionally, rotor seals (rotating seals) 73 and 74 are respectively provided on an inner peripheral end and an outer peripheral end of the annular protruding portion 71 of the rotating table 7, and a space between the rotating table 7 and the table support portion 8 facing the rotating table 7 is closed by the rotor seals 73 and 74. Accordingly, a second hydraulic chamber R2 in which an inner peripheral end and an outer peripheral edge are delimited by the rotor seals 73 and 74, a top surface (upper surface) is the protruding portion 71 of the rotating table 7, and a bottom surface is an annular sealed space formed by the housing portion 81 of the table support portion 8 is formed below the rotating table 7. As illustrated in FIG. 4, since the second hydraulic chamber R2 includes a space formed by the recess 72 and the recess 82, the thrust bearing 70 is installed in the second hydraulic chamber R2.

In addition, although not illustrated in FIGS. 2 to 4, as illustrated in FIG. 1, the compressive torsion forming device 1 is provided with a pressure guide oil passage L2 that connects (communicates) the first hydraulic chamber R1 and the second hydraulic chamber R2. As illustrated in FIG. 4, the table support portion 8 is provided with a pipe 85 that communicates with the second hydraulic chamber R2. The pipe 85 is a part of the pressure guide oil passage L2. The pressure oil from the first hydraulic chamber R1 is supplied to the second hydraulic chamber R2 via the pipe 85 provided in the table support portion 8. Since the first hydraulic chamber R1 and the second hydraulic chamber R2 communicate with each other through the pressure guide oil passage L2, the internal pressures of the first hydraulic chamber R1 and the second hydraulic chamber R2 are always kept equal.

In the above compressive torsion forming device 1, when the processing of the processing material O is performed, the pressure oil is supplied to the press cylinder 5 via the pressure application oil passage L1. Accordingly, since the ram 52 is pushed downward, the upper die 11 fixed to the ram 52 via the slide 6 presses the processing material O downward, so that the compressive torsion forming device 1 applies a compressive stress to the processing material O. That is, the compressive torsion forming device 1 compresses and deforms the processing material O.

Additionally, the two rack shafts 92 are moved in directions opposite to each other by the operation of the hydraulic cylinder 93. Accordingly, in the turning bearing 91 with external teeth, the outer ring 91*b* provided with the external teeth 91*c* fitted with the rack teeth 92*a* rotates in a predetermined direction. As a result, since the rotating table 7 to which the outer ring 91*b* is fixed also rotates together with the outer ring 91*b*, the lower die 12 attached to the rotating table 7 rotates, and the compressive torsion forming device 1 applies a shear stress to the processing material O. That is, the compressive torsion forming device 1 causes the processing material O to undergo shear deformation.

Here, in the related-art compressive torsion forming device, the thrust load received by the lower die due to the application of pressure by the upper die is entirely applied to the thrust bearing. Therefore, when the applied pressure applied by the upper die increases, the thrust load applied to the thrust bearing increases accordingly. Normally, the thrust bearing is not only difficult to rotate with a low torque in a state where the thrust bearing has received a high load, but also may be damaged when the thrust bearing receives a high load. Therefore, it is necessary to limit the applied pressure applied by the upper die to a range that does not damage the thrust bearing.

In contrast, in the compressive torsion forming device 1 according to the present embodiment, the thrust load received by the lower die 12 due to the application of pressure by the upper die 11 can also be decentralized not only to the thrust bearing 70 but also to the pressure oil in the second hydraulic chamber R2. That is, the second hydraulic chamber R2 functions as a fluid bearing for the rotating table 7. This is because, as described above, the first hydraulic chamber R1 and the second hydraulic chamber R2 are held in a state where the internal pressures thereof are equal by the pressure guide oil passage L2. That is, when the pressure oil is supplied to the first hydraulic chamber R1 to increase the internal pressure of the first hydraulic chamber R1 and the applied pressure to the ram 52 is increased, the internal pressure of the second hydraulic chamber R2 also increases simultaneously. Therefore, the pressure oil in the second hydraulic chamber R2 can receive a part of the load generated by the ram 52 instead of the thrust bearing 70.

The pressure-receiving capacity in the second hydraulic chamber R2, that is, the load that can be received by a fluid bearing formed by the second hydraulic chamber R2 is based on a relationship between an effective pressure-receiving area S1 of the first hydraulic chamber R1 and an effective pressure-receiving area S2 of the second hydraulic chamber R2. As illustrated in FIG. 1, the effective pressure-receiving area is the area of a surface perpendicular to a direction in which the thrust load is applied (the direction of the axis A in the present embodiment). A ratio S2/S1 of the effective pressure-receiving area S2 of the second hydraulic chamber R2 to the effective pressure-receiving area S1 of the first hydraulic chamber R1 is the ratio of the load that the fluid bearing formed by the second hydraulic chamber R2 can receive to the applied pressure.

In the compressive torsion forming device 1, as illustrated in FIG. 4, the effective pressure-receiving area S2 of the second hydraulic chamber R2 is the area of the surface perpendicular to the axis A in the annular second hydraulic chamber R2 delimited by the rotor seals 73 and 74. In the compressive torsion forming device 1, S2/S1 is set to 0.9. As a result, 90% of the applied pressure applied by the ram 52 can be received by the fluid bearing formed by the second hydraulic chamber R2. Therefore, only the remaining 10% of the load becomes the load of the thrust bearing 70. When S2/S1 is increased, the ratio of the load that the thrust bearing bears can be decreased. However, it is necessary to design S2/S1 to be 1 or less.

In this way, in the compressive torsion forming device 1 according to the present embodiment, the second hydraulic chamber R2 communicating with the first hydraulic chamber R1 bears a part of the thrust load as the fluid bearing, and the thrust bearing 70 bears the remaining load. Therefore, the thrust load that the thrust bearing 70 bears can be reduced. That is, even when the applied pressure to the processing material O is increased, the thrust load applied to the thrust bearing 70 can be decreased with respect to the applied pressure. Therefore, it is possible to perform the processing of giving shear deformation in a state where the applied pressure is increased as compared with the related-art compressive torsion forming device.

Additionally, in the compressive torsion forming device 1 according to the present embodiment, the thrust bearing 70 is provided inside the second hydraulic chamber R2. The thrust bearing 70 can also be provided at a position independent of the second hydraulic chamber R2. However, as described above, by adopting a configuration in which the thrust bearing 70 is provided by utilizing the space of the second hydraulic chamber R2, it is not necessary to separately secure a space for providing the thrust bearing 70, and the space can be effectively utilized. Additionally, in the case of the above configuration, the lubricity of the thrust bearing 70 can be improved by the pressure oil in the second hydraulic chamber R2. Therefore, it is possible to prevent a frictional force different from the thrust load from being applied to the thrust bearing 70.

Additionally, the compressive torsion forming device 1 according to the present embodiment includes a configuration in which the rotation of the rotating table 7 is controlled using the rack shaft 92 and the hydraulic cylinder 93. Accordingly, the second hydraulic chamber R2 communicating with the first hydraulic chamber R1 bears a part of the thrust load as the fluid bearing, so that the rotational control of the rotating table 7 can be performed in a state where the rolling resistance force generated by the thrust bearing 70 is reduced. In this way, by providing the rotating mechanism 9 for controlling the rotation of the rotating table 7, it is possible to perform the processing of giving shear deformation in a state where the applied pressure applied to the processing material O is increased.

Additionally, in the compressive torsion forming device 1 according to the present embodiment, the turning bearing 91 with external teeth is used as the rotating mechanism 9 of the rotating table 7 to which the lower die 12 is attached, so that a force applied in the anti-thrust load direction (upward in the present embodiment) can be suppressed. As the rotating mechanism 9 of the rotating table 7, for example, a configuration in which gears are provided on the rotating table 7 itself can be adopted. Even in that case, by providing the second hydraulic chamber R2, the effect that the thrust load that the thrust bearing 70 bears can be reduced is obtained. However, in a case where the speed of decreasing the internal pressure of the first hydraulic chamber R1 is large and a delay occurs in the decrease of the internal pressure of the second hydraulic chamber R2, there is a possibility that a load may be generated in the anti-thrust load direction (the direction from the lower die 12 to the upper die 11). In a case where the load is generated in the anti-thrust load direction, it is considered that the press cylinder 5 may be damaged.

In contrast, since the turning bearing 91 with external teeth is attached to the rotating table 7, the turning bearing 91 with external teeth can receive the load in the anti-thrust load direction, and the load can be prevented from being applied in the anti-thrust load direction.

Although the embodiment according to the present invention has been described above, the present invention is not limited to the above embodiment, and various modifications can be added.

For example, the shape and disposition of the respective portions described in the compressive torsion forming device 1 described in the above embodiment can be appropriately changed. Additionally, in the above embodiment, a case where the press cylinder 5 is the ram type has been described. However, the press cylinder may be of a piston type. In a case where the piston type press cylinder is used, the pullback cylinder 61 may not be provided. Additionally, the shapes of the first hydraulic chamber R1 and the second hydraulic chamber R2 may be changed, and the disposition of the thrust bearing 70, and the like may be changed.

Additionally, the rotating mechanism 9 may be different from a mechanism using gears as described in the above embodiment. Moreover, even in a case where the rotating mechanism 9 that controls the rotation of the rotating table 7 is not provided, the effect that the thrust load that the thrust bearing 70 bears can be reduced is obtained by providing the second hydraulic chamber R2 that receives the thrust load applied to the rotating table 7.

Additionally, in the above embodiment, a case where the upper die 11 (first die) pressurizes the processing material O to apply a compressive stress, and the lower die 12 (second die) rotates about the axis A to apply shear deformation to the processing material O has been described above. However, the functions of the upper die 11 and the lower die 12 may be reversed. That is, the lower die 12 may be configured to press the processing material O to give a compressive stress, and the upper die 11 may rotate about the axis A to apply shear deformation to the processing material O. Additionally, the direction in which the pair of dies is disposed and the direction in which the axis A extends can be appropriately changed.

It should be understood that the invention is not limited to the above-described embodiment, but may be modified into various forms on the basis of the spirit of the invention. Additionally, the modifications are included in the scope of the invention.

What is claimed is:

1. A compressive torsion forming device for processing a processing material using a first die and a second die facing each other, the compressive torsion forming device comprising:

a sliding portion that includes a first hydraulic chamber, and slides in accordance with a change in internal pressure of the first hydraulic chamber so as to move the first die in a direction of an axis;

a rotating table provided with the second die and rotatable about the axis;

a table support portion provided opposite to the second die with the rotating table interposed therebetween in the direction of the axis;

a rotational thrust bearing that rotatably supports the rotating table with respect to the table support portion, and receives a force acting on the rotating table in a direction from the second die toward the rotating table; and a second hydraulic chamber that is provided between the rotating table and the table support portion and communicates with the first hydraulic chamber, wherein the rotational thrust bearing is provided inside the second hydraulic chamber.

2. The compressive torsion forming device according to claim 1, further comprising:

a rotating mechanism that controls rotation of the rotating table.

3. The compressive torsion forming device according to claim 2, wherein the rotating mechanism includes a turning bearing with external teeth having an outer ring attached to the rotating table.

4. The compressive torsion forming device according to claim 3, wherein the rotating mechanism includes the turning bearing with external teeth, a rack shaft, and a hydraulic cylinder that moves the rack shaft.

5. The compressive torsion forming device according to claim 4, wherein the turning bearing with external teeth includes an inner ring, the outer ring, and external teeth.

6. The compressive torsion forming device according to claim 5, wherein the inner ring is attached to the table support portion, and the external teeth are provided on an outer peripheral side of the outer ring and function as a gear when the rotating table rotates.

7. The compressive torsion forming device according to claim 4, wherein two rack shafts are provided so as to be point-symmetrical about the axis.

8. The compressive torsion forming device according to claim 1, wherein the rotating table has a disk shape centered on the axis, and a central portion of a lower surface thereof is provided with an annular protruding portion centered on the axis, and the table support portion is provided with an annular housing portion corresponding to a shape of the protruding portion of the rotating table.

9. The compressive torsion forming device according to claim 8, wherein the protruding portion is provided with an annular recess centered on the axis.

10. The compressive torsion forming device according to claim 9, wherein the recess has a shape that is recessed upward from a lower surface of the protruding portion.

11. The compressive torsion forming device according to claim 1, further comprising:

a lower frame to which the table support portion is attached; and an upper frame provided opposite to the first die with the sliding portion interposed therebetween in the direction of the axis.

12. The compressive torsion forming device according to claim 11, wherein the upper frame is provided with a press cylinder, and the press cylinder includes the sliding portion.

13. The compressive torsion forming device according to claim 12, wherein a pressure application oil passage that supplies pressure oil for controlling an applied pressure in the press cylinder is connected to the first hydraulic chamber.

14. The compressive torsion forming device according to claim 13, wherein the pressure application oil passage is connected to a hydraulic oil supply source configured to supply the pressure oil.

15. The compressive torsion forming device according to claim 11, further comprising:

a slide to which the first die is fixed.

16. The compressive torsion forming device according to claim 15, wherein the slide is provided with a pullback cylinder coupled to the upper frame.

17. The compressive torsion forming device according to claim 16, wherein the pullback cylinder is used when the press cylinder is retracted.

* * * * *